US008156877B1

(12) United States Patent
Carr

(10) Patent No.: US 8,156,877 B1
(45) Date of Patent: Apr. 17, 2012

(54) ELECTROSTATIC SEWING TEMPLATE

(75) Inventor: Kari Carr, Fergus Falls, MN (US)

(73) Assignee: Kari Carr, Fergus Falls, MN (US)

( * ) Notice: Subject to any disclaimer, the term of this patent is extended or adjusted under 35 U.S.C. 154(b) by 592 days.

(21) Appl. No.: 12/388,583

(22) Filed: Feb. 19, 2009

Related U.S. Application Data

(60) Provisional application No. 61/032,759, filed on Feb. 29, 2008, provisional application No. 61/145,682, filed on Jan. 19, 2009.

(51) Int. Cl.
*D05B 37/00* (2006.01)

(52) U.S. Cl. ..... 112/117; 33/566

(58) Field of Classification Search ..... 112/117–119, 112/475.08, 475.18; 33/484, 562–566
See application file for complete search history.

(56) References Cited

U.S. PATENT DOCUMENTS

| | | | | |
|---|---|---|---|---|
| 4,779,346 | A * | 10/1988 | Schafer | 33/1 B |
| 4,945,642 | A * | 8/1990 | Saulietis | 33/17 R |
| 5,665,448 | A | 9/1997 | Graham et al. | |
| 5,791,062 | A * | 8/1998 | Walker | 33/563 |
| 5,819,422 | A * | 10/1998 | Schafer | 33/1 B |
| 6,106,760 | A | 8/2000 | Graham et al. | |
| 6,159,325 | A | 12/2000 | Graham et al. | |
| 6,276,070 | B1 * | 8/2001 | Hawley | 33/563 |
| 6,321,458 | B1 * | 11/2001 | Hess | 33/566 |
| 6,862,823 | B2 * | 3/2005 | deCarteret | 38/102 |
| 6,925,724 | B2 * | 8/2005 | Tandy | 33/563 |
| 7,178,249 | B2 * | 2/2007 | Schafer et al. | 33/1 B |
| D549,115 | S * | 8/2007 | Tucker | D10/64 |
| 7,281,337 | B1 * | 10/2007 | Oehlke et al. | 33/566 |
| 7,383,640 | B2 * | 6/2008 | Barry | 33/562 |
| D577,617 | S * | 9/2008 | Tucker | D10/64 |
| 7,421,796 | B1 * | 9/2008 | DeAngelis-Morris | 33/613 |
| 7,568,295 | B1 * | 8/2009 | Strain | 33/566 |
| 7,730,842 | B1 * | 6/2010 | Sebrow | 112/117 |
| 7,770,303 | B2 * | 8/2010 | Graham et al. | 33/562 |
| D640,941 | S * | 7/2011 | Tucker | D10/64 |
| 2006/0032068 | A1 * | 2/2006 | Sherman et al. | 33/566 |
| 2009/0025245 | A1 * | 1/2009 | Brady | 33/562 |
| 2011/0113999 | A1 * | 5/2011 | Widell et al. | 112/103 |

OTHER PUBLICATIONS

Pam Bono Designs, Inc., Angler 2 Product Literature (copyright date not listed).

* cited by examiner

*Primary Examiner* — Larry Worrell, Jr.
(74) *Attorney, Agent, or Firm* — Marsh Fischman & Breyfogle LLP

(57) ABSTRACT

A sewing template and associated method to aid in the production of components for a quilt are provided. The sewing template may include a needle position indicator and a center guide line passing through the needle position indicator. The sewing template may be constructed from a material that is operable to cling to a work surface, such as an acrylic sewing table. The sewing template may include color-coded regions to assist a quilter in producing components with various patterns. The sewing template may further include features to assist in initially aligning the template with a sewing machine and/or a sewing work surface.

20 Claims, 11 Drawing Sheets

ELECTROSTATIC SEWING TEMPLATE

RELATED APPLICATIONS

This application claims priority from each of U.S. Provisional Patent Application Ser. No. 61/032,759, filed Feb. 29, 2008, and U.S. Provisional Patent Application Ser. No. 61/145,682, filed Jan. 19, 2009, and entitled "ELECTROSTATIC SEWING TEMPLATE." The entire disclosure of each of these provisional patent applications is hereby incorporated by reference in their entirety herein.

FIELD OF THE INVENTION

The present invention generally relates to sewing aides and, more particularly to a template operable to assist in executing various sewing operations (e.g., creating fabric sections that may be incorporated into a quilt).

BACKGROUND

Quilts may be made from many small patches and/or pieces of fabric arranged to create patterns and/or images. The patches may consist of a single piece of material, or they may be constructed from multiple pieces of material sewn together by hand or machine. One common style of patch is a triangle square, which is a square piece that consists of two pieces of material sewn together to form a square patch with a seam between the two pieces of material disposed along a diagonal of the square.

To produce a triangle square using a sewing machine, a user may incorporate paper patterns that may be pinned to the fabric to be sewn, or the user may draw guide lines on the material to be sewn. Such methods require preparatory steps before sewing that may be time consuming. Templates and/or guide lines may be used to attempt to guide the user while sewing together fabric to produce patches of material for quilts.

SUMMARY

A first aspect of the present invention is embodied by a sewing template that includes a sheet, a needle position indicator disposed on the sheet, and a center guide line disposed on the sheet. The sheet may be in the form of a cling film or cling. The center guide line may be a straight line intersecting the needle position indicator.

A number of feature refinements and additional features are separately applicable in relation to the above-noted first aspect of the present invention. These feature refinements and additional features may be used individually or in any combination in relation to the first aspect. Each of the following features that will be discussed is not required to be used with any other feature or combination of features unless otherwise specified.

The sewing template may include polyvinyl chloride. The sewing template may be generally clear and the various lines, colored areas and bands discussed herein may be at least partially opaque lines and/or areas disposed on the sewing template. The sewing template may include a horizontal guide line perpendicular to the center guide line and passing through the needle position indicator. The sewing template may further include a removable backing.

The sewing template may include first and second pluralities of angled guide lines disposed on the sheet. Each angled guide line of the first plurality of angled guide lines may be oriented at 45 degrees with respect to the center guide line.

Moreover, each angled guide line of the first plurality of angled guide lines may be parallel to every other angled guide line of the first plurality of angled guide lines. Similarly, each angled guide line of the second plurality of angled guide lines may be oriented at 45 degrees with respect to the center guide line, and each angled guide line of the second plurality of angled guide lines may be parallel to every other angled guide line of the second plurality of angled guide lines. The first plurality of angled guide lines may be disposed on an opposite side of the center guide line from the second plurality of angled guide lines. The first plurality of angled guide lines may be disposed perpendicular to the second plurality of angled guide lines. Alternating spaces between individual angled guide lines of the first and second plurality of angled guide lines may be filled with a first color. A second set of alternating spaces (between the aforementioned alternating spaces between the angled guide lines filled with the first color) may exclude the first color. The second set of alternating spaces may be clear or filled with a color visually discernable from the first color (e.g., a different color).

The sewing template may further include a bottom surface, a top surface, a bottom edge, a top edge, a left edge, and a right edge. The bottom edge may be parallel to the top edge, the left edge may be parallel to the right edge, and the center guide line may be perpendicular to the bottom edge and parallel to the left edge. When viewing the sheet from above the top surface with the top edge up, the left edge is to the left of the center guide line. The sewing template may further include a first offset guide line disposed on the sheet, that is parallel to the center guide line and offset from the center guide line toward the left edge by a first length. The sewing template may further include a no-waste guide line disposed on the sheet. The no-waste guide line may be a straight line that intersects the first offset guide line at a first point that is closer to the top edge than the needle position indicator by the first length. The no-waste guide line may extend from the first point toward the bottom edge and toward the left edge at an angle of 45 degrees from the center guide line. The no-waste guide line may be parallel to the first plurality of angled guide lines. The no-waste guide line and the first offset guide line may be similarly color coded in a second color that may be different than the first color. Such similar color coding may be in the form of colored areas or bands of the second color adjoining the no-waste guide line and the first offset guide line. Such similar color coding may be in the form of the no-waste guide line and the first offset guide line being of the second color. In an embodiment, the first length may be ¼".

In an embodiment, the sewing template may include a first offset guide line offset from and parallel to the center guide line. The first offset guide line may be offset to a first side of the center guide line by ¼". The sewing template may also include a second offset guide line disposed offset from and parallel to the center guide line. The second offset guide line may be offset to a second side of the center guide line by ¼". Additionally, the sewing template may also include a third offset guide line offset from and parallel to the center guide line. The third offset guide line may be offset to the first side of the center guide line by ⅝". The sewing template may also include a fourth offset guide line offset from and parallel to the center guide line. The fourth offset guide line may be offset to the second side of the center guide line by ⅝".

First portions of each of the center guide line and first through fourth offset guide lines may be disposed between the needle position indicator and the bottom edge, and second portions of each of the center guide line and first through fourth offset guide lines may be disposed between the needle position indicator and the top edge.

The sewing template may further include a first fabric alignment line extending from the needle position indicator toward the top edge and toward the left edge at an angle of 45 degrees from the center guide line, and a second fabric alignment line extending from the needle position indicator toward the top edge and toward the right edge at an angle of 45 degrees from the center guide line.

A second aspect of the present invention is embodied by a sewing template that includes a sheet, a needle position indicator, a center guide line, and first and second pluralities of angled guide lines all disposed on the sheet. The center guide line may be a straight line intersecting the needle position indicator. Each angled guide line of the first plurality of angled guide lines may be oriented at 45 degrees with respect to the center guide line. Each angled guide line of the first plurality of angled guide lines may be parallel to every other angled guide line of the first plurality of angled guide lines. Each angled guide line of the second plurality of angled guide lines may be oriented at 45 degrees with respect to the center guide line. Each angled guide line of the second plurality of angled guide lines may be parallel to every other angled guide line of the second plurality of angled guide lines. The first plurality of angled guide lines may be disposed on an opposite side of the center guide line from the second plurality of angled guide lines. The first plurality of angled guide lines may be disposed perpendicular to the second plurality of angled guide lines. Alternating spaces between individual angled guide lines of the first and second pluralities of angled guide lines may be filled with a first color. A second set of alternating spaces (between the aforementioned alternating spaces between the individual angled guide lines filled with the first color) may exclude the first color. The second set of alternating spaces may be clear or filled with a color visually discernable from the first color.

A third aspect of the present invention is embodied by a method of installing a sewing template onto a sewing work surface. The method includes aligning a needle position indicator with a needle of a sewing machine, aligning another feature (e.g., a guide line or an edge) of the sewing template with a feature of the sewing machine and/or the sewing work surface, contacting the sewing template to the sewing work surface and/or a portion of the sewing machine, and removing a portion of the sewing template after the aligning steps and the contacting step. The portion removed in the removing step may encompass the needle position indicator. After the removing step, the sewing template may include a through hole where the portion was previously disposed, and the through hole may be disposed entirely within an outer perimeter of the sewing template.

A number of feature refinements and additional features are separately applicable in relation to the above-noted third aspect of the present invention. These feature refinements and additional features may be used individually or in any combination in relation to the third aspect. Each of the following features that will be discussed is not required to be used with any other feature or combination of features unless otherwise specified.

The method may further include peeling away a backing material from the sewing template. The method may further include, after the removing step, separating the sewing work surface from the sewing machine, wherein after the separating step, the sewing template remains in contact with the sewing work surface. In this regard, the sewing template may remain installed on the sewing work surface when the sewing work surface is removed from the sewing machine. Furthermore, the entire sewing template may be removed from the sewing work surface after it has been installed. The sewing template may then be reinstalled by aligning features of the sewing template (guide lines, edges—including the edges from the removal of the portion) with features of the sewing work surface and/or sewing machine and contacting the sewing template to the sewing work surface and/or sewing machine.

In an embodiment, the removed portion may substantially coincide with a throat plate of the sewing machine. In another embodiment, the removed portion may be smaller than the throat plate (e.g., the removed portion may not "match" the entirety of the throat plate). For example, the portion may correspond with the area occupied by feed dogs and a needle of the sewing machine.

A fourth aspect of the present invention is embodied by a sewing template that includes a cling and at least one sewing guide incorporated by the cling.

A number of feature refinements and additional features are separately applicable in relation to the above-noted fourth aspect of the present invention. These feature refinements and additional features may be used individually or in any combination in relation to the fourth aspect. Each of the following features that will be discussed is not required to be used with any other feature or combination of features unless otherwise specified.

The cling may be attachable to a sewing work surface exclusively by electrostatic charges.

In an embodiment, the at least one sewing guide may include a plurality of first bands and a plurality of second bands that may be different from the plurality of first bands. In this regard, the plurality of first bands may be visually different from the plurality of second bands. Each of the plurality of first bands may be of a first color, and each of the plurality of second bands may exclude the first color. For example, each of the plurality of second bands may be transparent, or each of the plurality of second bands may be of a second color. The first bands and second bands may be arranged such that at least one second band is disposed between each adjacent pair of first bands.

The at least one sewing guide may include a first guide line. The first bands may be disposed such that a first plurality of first bands is disposed on a first side of the first guide line and a second plurality of first bands is disposed on a second side of the first guide line. Similarly, the second bands may be disposed such that a first plurality of second bands is disposed on the first side of the first guide line and a second plurality of second bands is disposed on the second side of the first guide line.

A fifth aspect of the present invention is embodied by a sewing template that includes a sheet, a first guide line, a first and second pluralities of first bands, and a first and second pluralities of second bands. The first plurality of first bands and the first plurality of second bands may be disposed on a first side of the first guide line, and the second plurality of first bands and the second plurality of second bands may be disposed on a second side of the first guide line. Each first band of the first and second pluralities of first bands may be of a first color, and each second band of the first and second pluralities of second bands may exclude the first color.

A number of feature refinements and additional features are separately applicable in relation to the above-noted fifth aspect of the present invention. These feature refinements and additional features may be used individually or in any combination in relation to the fifth aspect. Each of the following features that will be discussed is not required to be used with any other feature or combination of features unless otherwise specified.

In an embodiment, each of the plurality of second bands may include a transparent section of the sheet. In an embodiment, each of the plurality of second bands may include a second color.

At least one second band may be disposed between each adjacent pair of first bands on each of the first and second sides of the first guide line. Similarly, at least one first band may be disposed between each adjacent pair of second bands on each of the first and second sides of the first guide line. The first plurality of first bands and the first plurality of second bands may be disposed in parallel relation to each other, and the second plurality of first bands and the second plurality of second bands may be disposed in parallel relation to each other.

Each first band of the first plurality of first bands and a corresponding first band of the second plurality of first bands may be separated by an included angle of 90°. Such corresponding pairs of first bands may be disposed in a mirror image relationship on opposing sides of the first guide line. Similarly, each second band of the first plurality of second bands and a corresponding second band of the second plurality of second bands may be separated by an included angle of 90°. Such corresponding pairs of second bands may be disposed in a mirror image relationship on opposing sides of the first guide line.

The sewing template of the current aspect may further include a third band and an adjoining fourth band that may be different from the third band. A boundary between the third and fourth bands may define the first guide line. The third and fourth bands may be of different colors. The third and fourth bands may be of a common width (e.g., they may be ¼" wide).

The sewing template may include a second guide line that may be orthogonal to the first guide line. The sewing template may be configured such that one second band is disposed between each adjacent pair of first bands and adjoins each first band of the adjacent pair of first bands. The sewing template may further include a fifth band that adjoins a single one of the plurality of first bands.

In an embodiment, the sewing template may include third and fourth guide lines that may be separated by an included angle of 90°, wherein the first, second, third, and fourth guide lines intersect at a common point. The third guide line may be orthogonal to each of the first plurality of first bands and the first plurality of second bands, and the fourth guide line may be orthogonal to each of the second plurality of first bands and the second plurality of second bands.

In an embodiment, the sewing template may include third and fourth guide lines disposed on opposite sides of and parallel to the first guide line. The third and fourth guide lines may be equally spaced from the first guide line. The third and fourth guide lines may be each spaced ⅝" from the first guide line.

A sixth aspect of the present invention is embodied by a sewing machine and any above-described sewing template.

A number of feature refinements and additional features are separately applicable in relation to the above-noted sixth aspect of the present invention. These feature refinements and additional features may be used individually or in any combination in relation to the sixth aspect. Each of the following features that will be discussed is not required to be used with any other feature or combination of features unless otherwise specified.

The sewing assembly may be arranged such that a sewing needle of the sewing machine is aligned with the above-described common point. The sewing assembly may include a bed and a support table that adjoins the bed, and the sewing template may be fixed on and held relative to the support table exclusively by electrostatic charges.

The feature refinements and additional features discussed above in relation to each of the first through sixth aspects may be used individually or in any combination with any appropriate aspect discussed herein. Additional aspects and advantages of the present invention will become apparent to one skilled in the art upon consideration of the further description that follows. It should be understood that the detailed description and specific examples are intended for purposes of illustration only and are not intended to limit the scope of the invention. Furthermore, any of the above arrangements, features and/or embodiments may be combined with any of the above aspects where appropriate.

DETAILED DESCRIPTION

Figure 1:
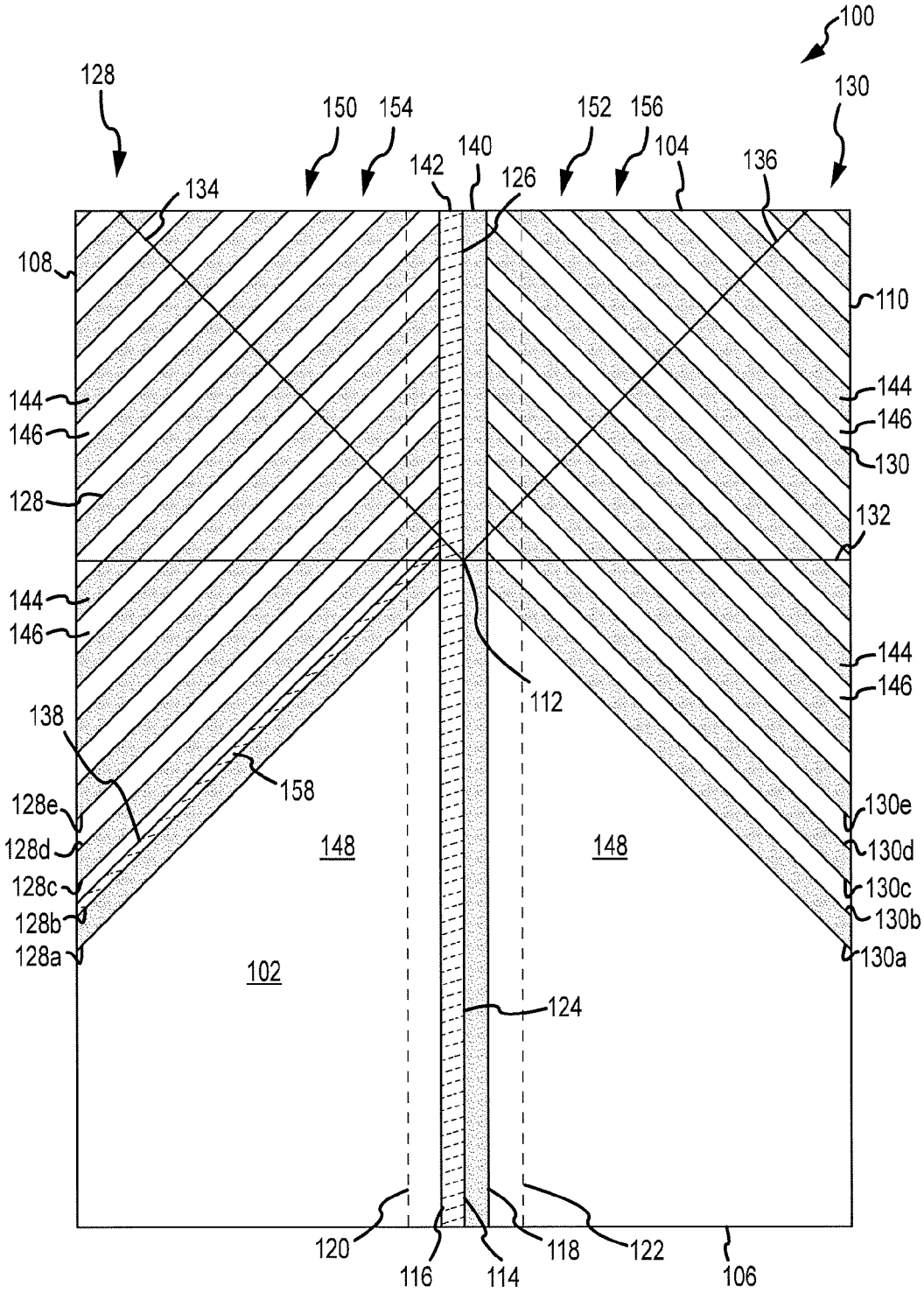
FIG. 1 is a plan view of an embodiment of a sewing template.
Figure 2A:
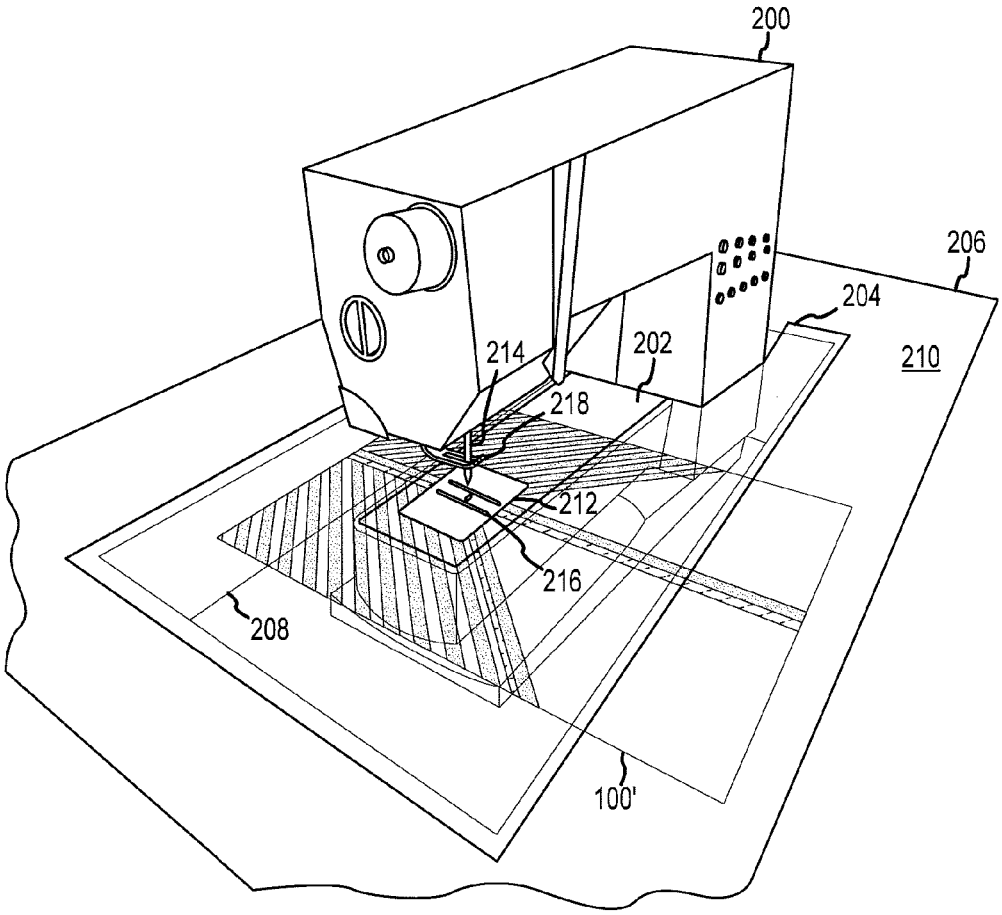
FIG. 2A is a perspective view of a representative sewing machine and work surface with the sewing template of FIG. 1 installed thereon and configured for sewing operations.
Figure 2B:
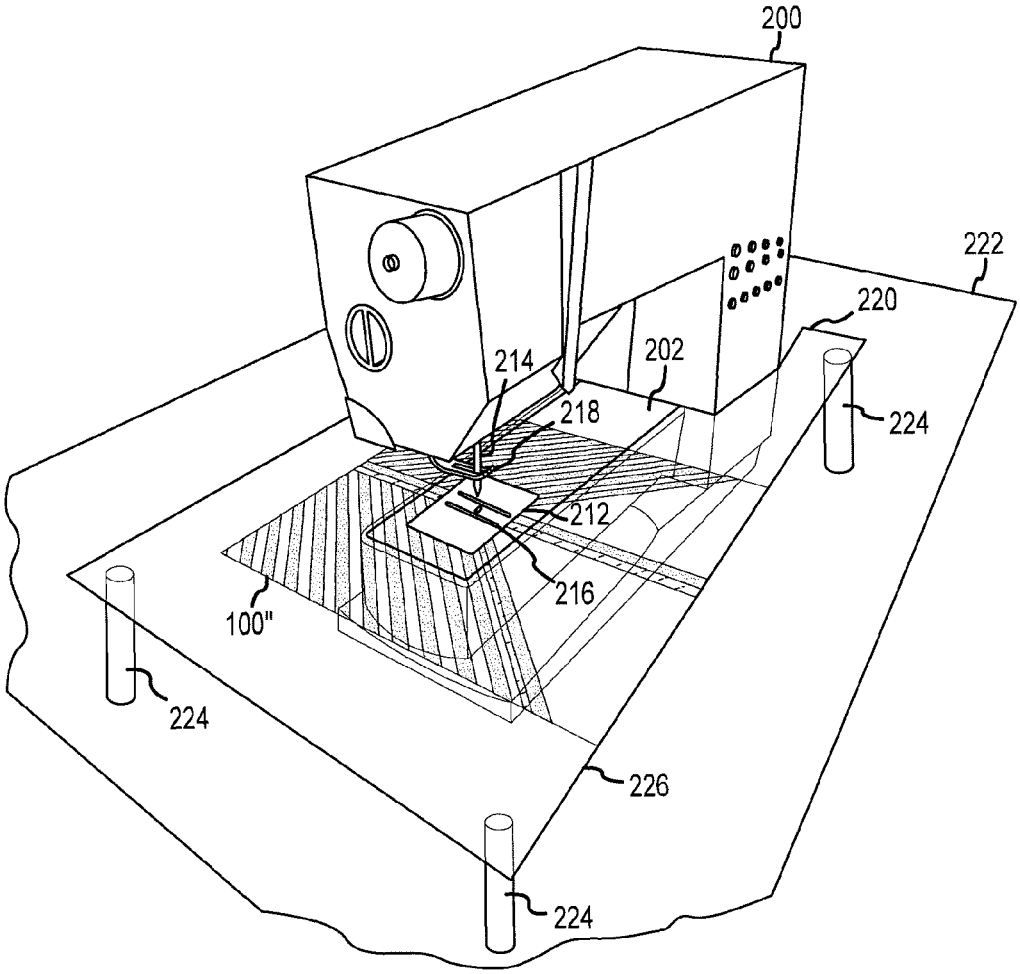
FIG. 2B is a perspective view of the representative sewing machine of FIG. 2A and a portable sewing table with the sewing template of FIG. 1 installed thereon and configured for sewing operations.

FIG. 1 is an illustration of one embodiment of a sewing template 100. The sewing template 100 may be in the form of a series of guide lines and/or shaded or colored regions disposed on a surface (e.g., top surface 102) of the sewing template 100. The sewing template 100 may be made from a material operable to cling (e.g., adhere to a surface due to electrostatic forces between the sewing template 100 and the surface; adhere to a coinciding surface at least primarily due to static electricity) to various surfaces that may be a part of or used in conjunction with a sewing machine 200 (FIGS. 2A and 2B). For example, the sewing template 100 may include polyvinyl chloride (PVC) or any other appropriate material. At least part of the sewing template 100 may be made from a generally clear material, thus enabling a user of the sewing template 100 to see components and/or features disposed below the sewing template 100 while the sewing template 100 is installed and/or in use. Such components and/or features may, for example, include a sewing machine bed 202 and/or additional guide lines on a sewing machine 200 and/or sewing work surface 204 (FIG. 2A).

As illustrated in FIG. 1, the sewing template 100 may be generally rectangular in shape. Other appropriate shapes may be used for the sewing template 100. As illustrated in FIG. 1, the sewing template 100 may include a top edge 104, a bottom edge 106, a left edge 108, and a right edge 110. As illustrated, the top edge 104 may be parallel to the bottom edge 106, and the left edge 108 may be parallel to the right edge 110 and perpendicular to each of the top edge 104 and bottom edge 106.

The sewing template 100 includes a needle position indicator 112. The needle position indicator 112 may be positioned at a point where a plurality of guide lines intersect, as illustrated in FIG. 1. Additionally, the needle position indicator 112 may be demarcated by a unique symbol such as a small circle (not illustrated). A center guide line 114 may be disposed such that it extends (e.g., in a direction parallel to the left edge 108) from the top edge 104 to the bottom edge 106 passing through the needle position indicator 112. The center guide line 114 may be centered between the left edge 108 and the right edge 110 as illustrated, or it may be offset from the position illustrated. The needle position indicator 112 may be viewed as a dividing point or demarcation between a first portion 124 of the center guide line 114 disposed between the needle position indicator 112 and the bottom edge 106 and a second portion 126 of the center guide line 114 disposed between the needle position indicator 112 and the top edge 104.

A first offset guide line 116 may be disposed parallel to and offset from the center guide line 114. The first offset guide line 116 may, as illustrated in FIG. 1, be offset from the center guide line 114 toward the left edge 108. The first offset guide line 116 may be offset from the center guide line 114 by ¼". Similarly, a second offset guide line 118 may be disposed parallel to and offset from the center guide line 114. The second offset guide line 118 may, as illustrated in FIG. 1, be offset from the center guide line 114 toward the right edge 110. The second offset guide line 118 may be offset from the center guide line 114 by the same distance (e.g., ¼") as the offset between the first offset guide line 116 and the center guide line 114. In another embodiment, the first and second offset guide lines 116, 118 may be offset by a value greater or less than ¼".

The area between the center guide line 114 and the second offset guide line 118 may be shaded with a first color. The area between the center guide line 114 and first offset guide line 116 may be shaded with a second color that is readily distinguishable from the first color. In this regard, the area between the center guide line 114 and the second offset guide line 118 may be a band 140 of the first color and the area between the center guide line 114 and first offset guide line 116 may be a band 142 of the second color. The boundary between these the bands 140, 142 may form the center guide line 114.

A third offset guide line 120 may be disposed parallel to and offset from the center guide line 114. The third offset guide line 120 may, as illustrated in FIG. 1, be offset from the center guide line 114 toward the left edge 108. The third offset guide line 120 may be offset from the center guide line 114 by ⅝". Similarly, a fourth offset guide line 122 may be disposed parallel to and offset from the center guide line 114. The fourth offset guide line 122 may, as illustrated in FIG. 1, be offset from the center guide line 114 toward the right edge 110. The fourth offset guide line 122 may be offset from the center guide line 114 by the same distance (e.g., ⅝") as the offset between the third offset guide line 120 and the center guide line 114. In another embodiment, the third and fourth offset guide lines 120, 122 may be offset by a value greater or less than ⅝". The third and fourth offset guide lines 120, 122 may be configured such that they are readily distinguishable from the first and second offset guide lines 116, 118, as desired (e.g., by being dashed, dotted, or of a unique weight and/or color).

Similar to as discussed above with reference to the center guide line 114, each of the first, second, third, and fourth offset guide lines 116, 118, 120, 122 are divided into first portions disposed between the needle position indicator 112 and the bottom edge 106 and second portions disposed between the needle position indicator 112 and the top edge 104.

The sewing template 100 includes a first plurality of angled guide lines 128. For purposes of this description, a portion of the first plurality of angled guide lines 128 are labeled 128*a* through 128*e*. Each angled guide line of the first plurality of angle guide lines 128 is oriented at a 45 degree angle with respect to the center guide line 114. Furthermore, all of the angled guide lines of the first plurality of angled guide lines 128 are parallel to each other. As illustrated in FIG. 1, the first plurality of angled guide lines 128 are disposed such that as they extend away from the center guide line 114 in a direction toward the left edge 108 and the bottom edge 106. A first angled guide line 128*a* of the first plurality of angled guide lines 128 intersects the needle position indicator 112. The remainder of the angle guide lines of the first plurality of angle guide lines 128 are disposed at regular intervals between the first angled guide line 128*a* and the top edge 104. Alternating areas between successive angled guide lines of the first plurality of angled guide lines 128 may be shaded with the first color (e.g., the same color as between the center guide line 114 and the second offset guide line 118). For example, the space between a third angled guide line 128*c* and a fourth angled guide line 128*d* may be shaded with the first color, while the space between the fourth angled guide line 128*d* and a fifth angled guide line 128*e* may exclude the first color (e.g., remain unshaded or be shaded with a different color). Such a pattern may be repeated throughout the area occupied by the first plurality of angled guide lines 128 (except for the space between a second angled guide line 128*b* and the third angled guide line 128*c* discussed below).

A second plurality of angled guide lines 130 may be disposed on the opposite side of the center guide line 114 from the first plurality of angled guide lines 128 and in a mirror image relation to the first plurality of angled guide lines 128. Accordingly, the first angled guide line 130*a* of the second plurality of angled guide lines 130 intersects the needle position indicator 112. Furthermore, alternating areas between successive angled guide lines of the second plurality of angled guide lines 130 may be shaded with the first color, while each of the remaining areas may exclude the first color (e.g., remain unshaded or be shaded with a different color).

The areas between successive angled guide lines 128, 130 described above may be referred to as bands. In this regard, the areas between angled guide lines 128 and 130 shaded with the first color make up a plurality of first bands 144. Similarly, the areas between angled guide lines 128 and 130 that exclude the first color (e.g., transparent or of a different color) make up a plurality of second bands 146. The boundaries between the plurality of first bands 144 and the plurality of second bands 146 may define the first and second plurality of angled guide lines 128, 130 with the exception of angled guide lines 128*a* and 130*a*. Guide line 128*a* may be formed by the boundary between the band disposed between angled guide lines 128*a* and 128*b* and an unbanded region 148. Guide line 130*a* may be formed by the boundary between the band disposed between angled guide lines 130*a* and 130*b* and the unbanded region 148. Moreover, the plurality of first bands 144 may be divided into a first plurality of first bands 150 disposed on a first side of the center guide line 114 and a second plurality of first bands 152 disposed on a second side of the center guide line 114. Similarly, the plurality of second bands 146 may be divided into a first plurality of second bands 154 disposed on the first side of the center guide line 114 and a second plurality of second bands 156 disposed on the second side of the center guide line 114.

The sewing template 100 may further include a horizontal guide line 132 that intersects the needle position indicator 112 and is perpendicular to the center guide line 114. Furthermore, the sewing template 100 may include a first fabric alignment line 134 that extends from the needle position indicator 112 toward the top edge 104 in a direction in line with and parallel to the first angled guide line 130*a*. The sewing template 100 may also include a second fabric alignment line 136 that extends from the needle position indicator 112 toward the top edge 104 in a direction in line with and parallel to the first angled guide line 128*a*.

A no-waste guide line 138 may be disposed on the sewing template 100 parallel to the first plurality of angled guides lines 128. The no-waste guide line 138 may be situated such that it intersects the first offset guide line 116 at a point that is closer to the top edge 104 than the needle position indicator 112 by a distance equal to the distance between the center guide line 114 and the first offset guide line 116. Such positioning enables production of no-waste triangle squares as described below with reference to FIGS. 6A through 6C. The no-waste guide line 138 may be disposed between the second angled line 128*b* and the third angled guide line 128*c*. The space between the no-waste guide line 138 and the second angled guide line 128*b* may form a band 158 and be shaded with the second color, which is also the color used to shade the area between the center guide line 114 and the first offset guide line 116.

FIG. 2A is an illustration of a first exemplary configuration of a representative sewing machine 200 and a sewing work surface 204 (e.g., defined by an insert, for instance an acrylic insert) with a modified sewing template 100' installed on the sewing work surface 204. For clarity, some of the guide lines (the third and fourth offset guide lines 120, 122, the first and second fabric alignment lines 134, 136, and the horizontal guide line 132) are not shown on the sewing template 100' of FIG. 2A, but they may be utilized as discussed herein. As used herein, the term "sewing machine" is intended to include typical sewing machines along with other stitching machines, such as sergers, that may also be used to interconnect separate pieces of material. The sewing machine 200 may be disposed on a work table 206 that includes a recessed region 208 and a top surface 210. The sewing machine 200 may be disposed on the work table 206 in the recessed region 208 such that the machine bed 202 of the sewing machine 200 is at about the same level as the top surface 210 of the work table 206. The sewing work surface 204 may generally be disposed such that it is coplanar with the machine bed 202 of the sewing machine 200. The sewing work surface 204 may generally be disposed such that a single, generally flat surface, that includes the machine bed 202, the sewing work surface 204, and the top surface 210, surrounds a throat plate 212 of the sewing machine 200. In this regard, portions of the modified sewing template 100' may be in contact with the machine bed 202, the sewing work surface 204, and the top surface 210. As illustrated in FIG. 2A, the sewing template 100 may be modified such that portions of the modified sewing template 100' surround the throat plate 212 and adhere to both the machine bed 202 and the sewing work surface 204.

FIG. 2B is an illustration of a second exemplary configuration of the representative sewing machine 200 and a portable sewing table or extension 220 with a modified sewing template 100" installed on the portable sewing table 220. The portable sewing table 220 may be made from acrylic, or any other appropriate material or combination of materials. For clarity, some of the guide lines (the third and fourth offset guide lines 120, 122, the first and second fabric alignment lines 134, 136, and the horizontal guide line 132) are not shown on the sewing template 100" of FIG. 2B, but they may be utilized as discussed herein. The sewing machine 200 and the portable sewing table 220 may be disposed on a flat surface 222. The acrylic work table 220 may include legs 224 operable to support the portable sewing table 220 such that its top surface is coplanar with the machine bed 202 of the sewing machine 200. As illustrated, the portable sewing table 220 may be shaped to generally surround the machine bed 202. As illustrated in FIG. 2B, the sewing template 100 may be trimmed such that portions of the modified sewing template 100" that do not correspond to a portion of the portable sewing table are removed. For example and as illustrated in FIG. 2B, such portions may include the portion corresponding to the machine bed 202 and a portion extending beyond an outside edge 226 of the portable sewing table 220.

Other appropriate configurations of work surfaces surrounding throat plates of sewing machines may also be used in conjunction with the sewing template 100. For example, the sewing template 100 may be used in conjunction with any appropriate work surface that is interconnected to the sewing machine 200. In another configuration, the sewing template 100 may be directly interconnected to a machine bed of a sewing machine, without the use of an additional work surface and/or work table.

As illustrated in FIGS. 2A and 2B, when installed and configured, the sewing template 100 may be positioned on a surface or surfaces that are coplanar with the machine bed 202 of the sewing machine 200. In this regard, the various features, guide lines and bands of the sewing template 100 may be used to help guide (e.g., as described herein) material as it is fed into the sewing machine 200. Additionally, the sewing template 100 may be trimmed as desired. For example, if desired, the modified sewing template 100' of FIG. 2A may be further modified by trimming the portion of the modified sewing template 100' that corresponds to the machine bed 202 (e.g., similar to the modified sewing template 100" of FIG. 2B).

Figure 4:
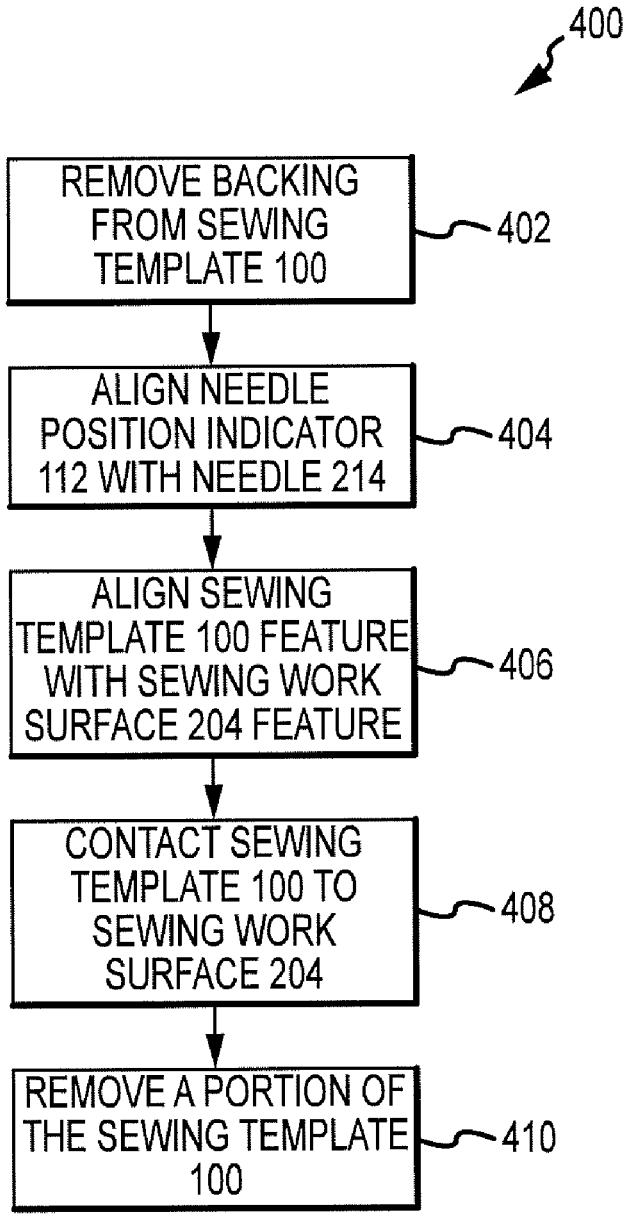
FIG. 4 is a flowchart of a method of installing the sewing template of FIG. 1.

FIG. 4 is a flowchart of a method 400 of installing the sewing template 100 of FIG. 1 to achieve the configuration of FIG. 2A. A first step 402 may be to remove a backing from the sewing template 100. The backing may prevent the sewing template 100 from inadvertently adhering to surfaces prior to installation.

The next step 404 may be to align the needle position indicator 112 with the needle 214 of the sewing machine 200. A presser foot 218 of the sewing machine 200 may be disposed proximate to the needle 214. While maintaining the alignment between the needle position indicator 112 and the needle 214, the next step 406 may be to align other features of the sewing template 100 such that the sewing template 100 is disposed such that the center guide line 114 is aligned with the needle 214 and parallel to the direction in which material is fed during sewing (the feed direction). For a first example, features on the sewing template 100 (e.g., the first, second, third, and/or fourth offset guide lines 116, 118, 120, 122) may be aligned with guide lines on the throat plate 212 of the sewing machine 200 that are offset from the needle 214 and aligned in the feed direction. For a second example, features on the sewing template 100 (e.g., the first, second, third, and/or fourth offset guide lines 116, 118, 120, 122) may be aligned with feed dogs 216 of the sewing machine 200. For a third example, the horizontal guide line 132 of the sewing template 100 may be aligned with indicators of the sewing machine 200 that are in line with the needle 214 and disposed perpendicular to the feed direction. For a fourth example, edges or other features of the sewing template 100 may be aligned with various edges or guide lines surrounding the sewing machine 200 that are either perpendicular or parallel to the feed direction. The first through fourth examples may be used individually or in any combination to align the sewing template 100. Furthermore, any other appropriate feature surrounding the needle 214 may be used to align the sewing template 100. Moreover, the sewing template 100 may be first aligned using a feature other than the needle position indicator 112 (such as those discussed above) and then the needle position indicator 112 may be aligned with the needle 214 of the sewing machine 200 (e.g., step 406 may be performed prior to or simultaneously with step 404) to achieve proper sewing template 100 positioning.

The method of installing the sewing template 100 may further include the step 408 of contacting the sewing template 100 to the sewing work surface 204. Such contacting may result in the sewing template 100 clinging to the sewing work surface 204 (e.g., adhering exclusively due to an electrostatic attraction between the sewing template 100 and the sewing work surface 204). If after the contacting step 408, the sewing template 100 is not properly aligned on the sewing work surface 204, the sewing template 100 may be separated from the sewing work surface 204 and realigned and recontacted.

Figure 3:
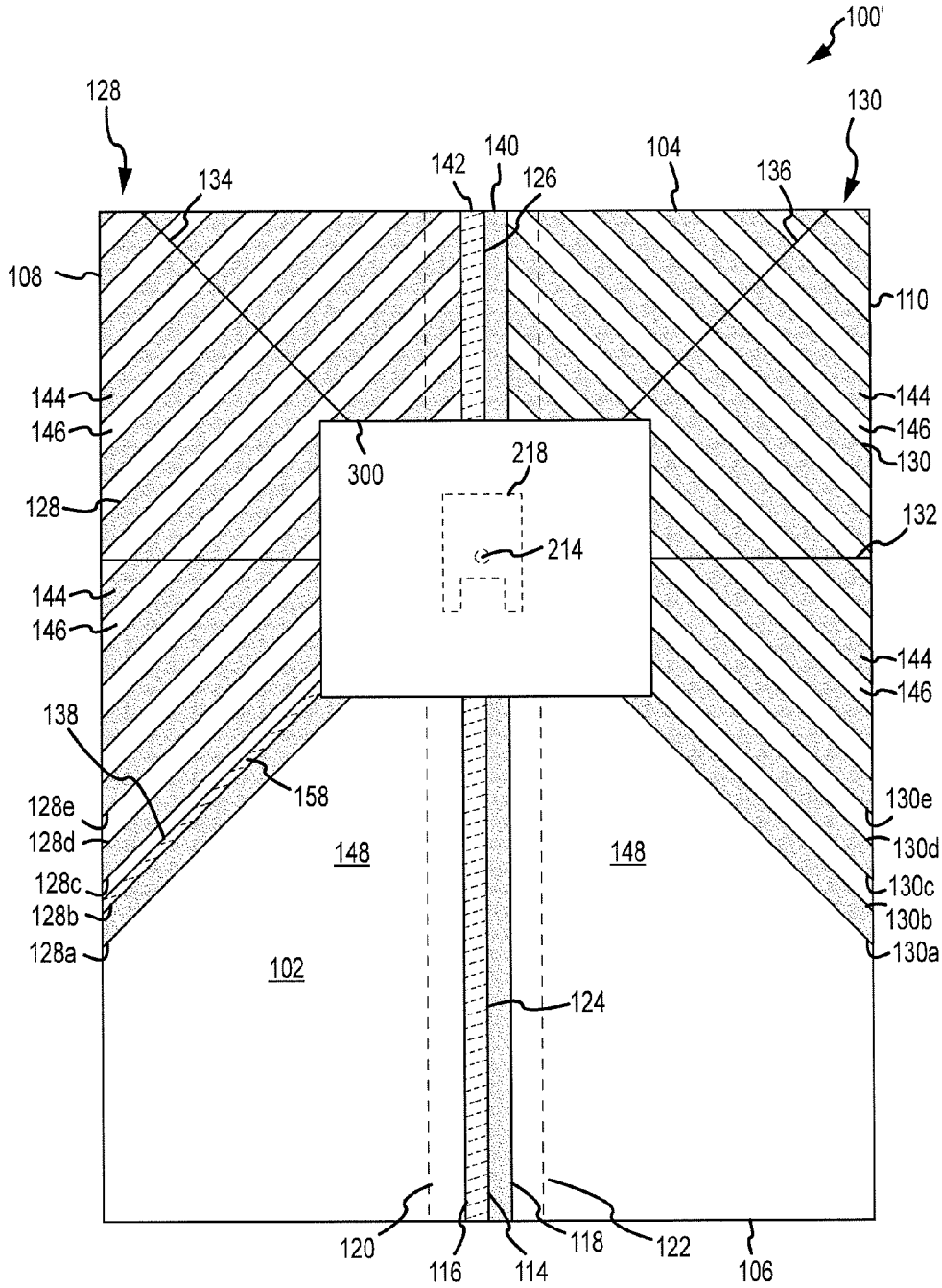
FIG. 3 is a plan view of the sewing template of FIG. 2A, where a center portion has been removed.

After the sewing template 100 has been properly aligned and is in contact with the work surface 204, the next step 410 may be to remove a portion of the sewing template 100 to create the modified sewing template 100' that includes a through-hole or cutout 300 as illustrated in FIG. 3. The through-hole 300 may be sized to avoid interfering with one or more components of the sewing machine 200. For example, the through-hole 300 may correspond with the outline of the throat plate 212 of the sewing machine 200. The through-hole 300 may be created by slicing through the sewing template 100 with a utility knife along the interface between the machine bed 202 and the throat plate 212 until the portion of the sewing template 100 corresponding with the through-hole 300 is separated from the remainder of the sewing template 100. The portion may then be removed by, for example, peeling it away from the throat plate 212.

In another example, a portion of the sewing template 100 corresponding to an area smaller than the throat plate 212 may be removed. For example, the area occupied by the feed dogs 216, an area between the feed dogs 216, and the area proximate to the needle 214 may be removed while a remaining portion of the sewing template 100 disposed proximate to the throat plate 212 may be retained.

The removal of the portion of the sewing template 100 may be performed as described above while the sewing template 100 is contact with the work surface 204. Alternatively, the sewing template 100 may be aligned and contacted and the sewing template 100 may be marked such that upon subsequent removal of the sewing template 100 from the sewing work surface 204, the sewing template 100 may be cut to form the modified sewing template 100'. After such an operation, the modified sewing template 100' may be realigned and re-contacted with the work surface 204.

After the portion of the sewing template 100 has been removed to form the through-hole 300, the modified sewing template 100' may be configured such as shown in FIG. 3. In such a configuration, no portion of the perimeter of the through hole 300 may be in contact with the outside perimeter (e.g., top edge 104, bottom edge 106, left edge 108 and right edge 110) of the modified sewing template 100'. The sewing template 100' may then be used for various sewing operations. If the sewing template 100' is not going to be needed for some time, it may remain in its installed position without interfering with other sewing operations. However, the sewing template 100' may be removed and re-installed in the above-noted manner, as desired.

After installation of the modified sewing template 100' such as illustrated in FIG. 2A, various components may be disassembled as desired. For example, the sewing work surface 204 may be removed from the sewing machine 200 while maintaining contact between the modified sewing template 100' and the sewing work surface 204 (e.g., the sewing template 100' may remain on the "detached" sewing work surface 204). In another example, the modified sewing template 100' may be peeled away from the sewing work surface 204. Once removed, the modified sewing template 100' may be reapplied to the backing material for storage until it is desired to reinstall the modified sewing template 100' on to the sewing work surface 204 in the above-noted manner. Along these lines, the sewing work surface 204 may be optionally marked or otherwise modified to aid in alignment of the modified sewing template 100' when reinstalling the modified sewing template 100' onto the sewing work surface 204. Similarly, the modified sewing template 100" of FIG. 2B may remain adhered to the portable sewing table 220 when the portable sewing table 220 is removed from the sewing machine 200.

Use of the modified sewing template 100' (e.g., the sewing template 100 configured for sewing operations) to produce standard triangle squares (which may also be referred to as single half-square triangles) and no-waste triangle squares (which may also be referred to as double half-square triangles) will now be described. As illustrated in FIG. 3, the modified sewing template 100' includes the through-hole 300. When installed onto the sewing work surface 204, the needle 214 and the presser foot 218 may be positioned as illustrated by the correspondingly labeled broken lines of FIGS. 3, and 5A through 6C.

Figure 5A:
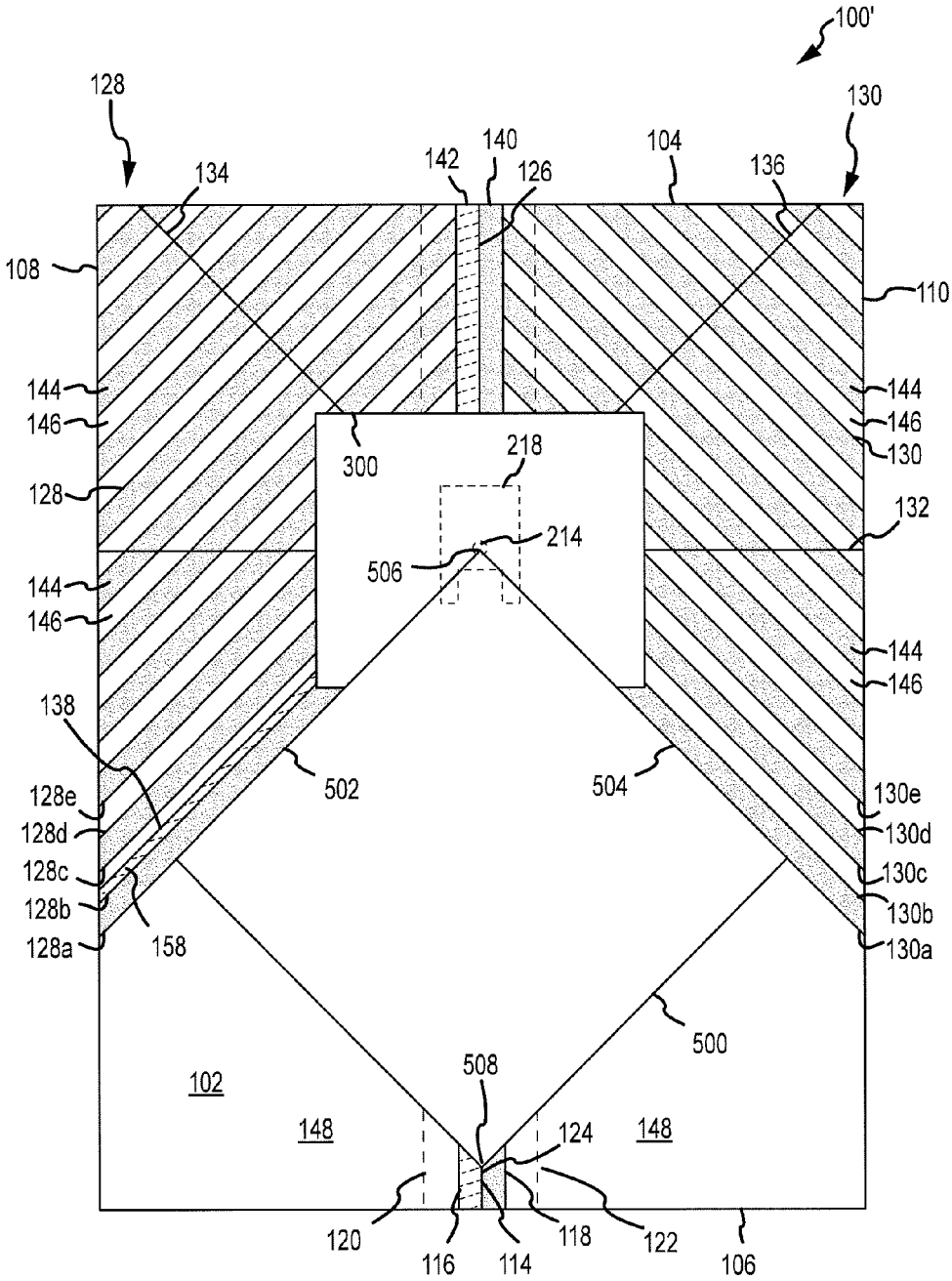
FIGS. 5A through 5C illustrate a sequence where the sewing template of FIG. 1 is used to join two square pieces of fabric together to produce a standard triangle square.
Figure 5B:
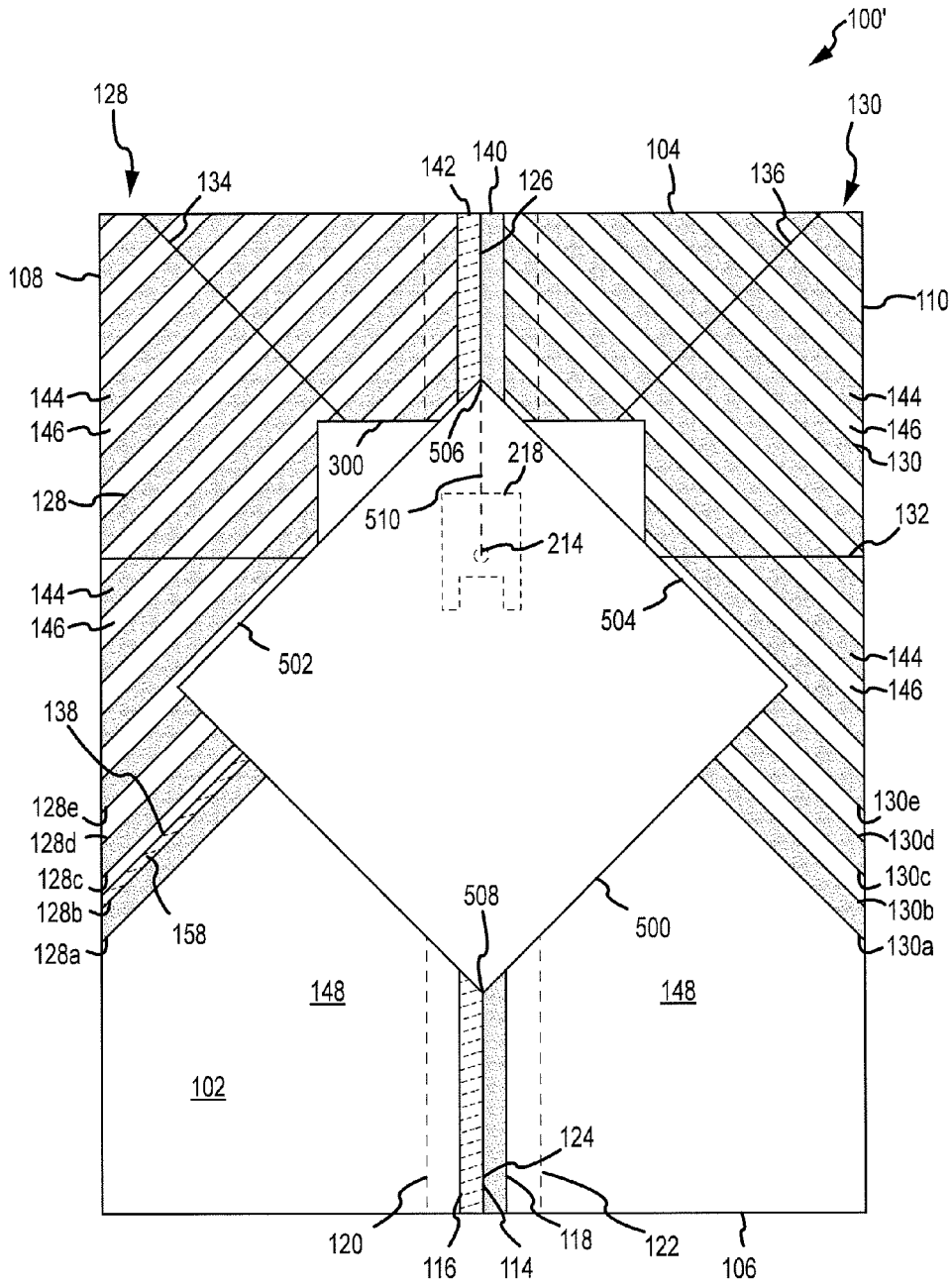
Figure 5C:
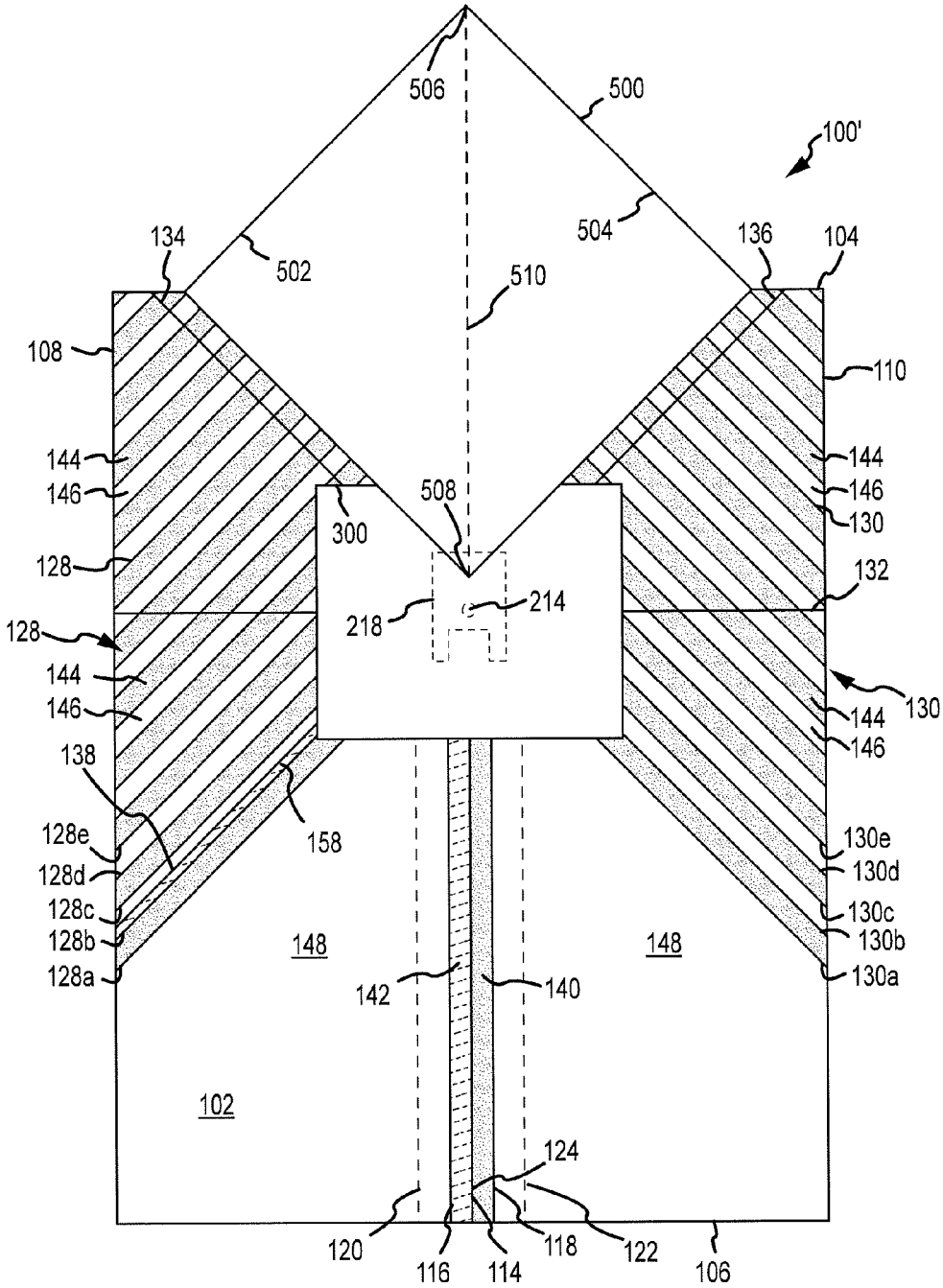

To produce a standard triangle square, two similarly sized square pieces of fabric 500 may be disposed face-to-face and aligned as illustrated in FIGS. 5A through 5C. In FIGS. 5A through 5C the two fabric pieces 500 are illustrated on top of each other such that only the top piece is visible. A first edge 502 of the fabric pieces 500 may be disposed along the first angled guide line 128*a* and a second edge 504 of the fabric pieces 500 may be disposed along the first angled guide line 130*a*. Such an orientation will place a lead corner 506 of the fabric pieces 500 at, or proximate to, the needle 214. Furthermore, a trailing corner 508 will be disposed along the first portion 124 of the center guide line 114.

Once aligned as illustrated in FIG. 5A, a user may begin to sew the fabric pieces 500 to each other by feeding the fabric pieces 500 into the sewing machine 200. As the fabric pieces 500 are fed into the sewing machine 200 (FIGS. 5B and 5C), several features of the modified sewing template 100' may aid the user in keeping the fabric pieces 500 properly aligned, thus helping to produce a straight sewn portion 510 extending from the lead corner 506 to the trailing corner 508. For example, while feeding the fabric pieces 500, the user may maintain the edge 502 in either a band 144 or band 146 on one side of the center guide line 114, and the edge 504 in the mirror image band 144, 146 on the opposite side of the center guide line 114 (e.g., have the edge 502 in a band 144 on one side of the center guide line 114, and the edge 504 in the mirror image band 144 on the opposite side of the center guide line 114). Having the bands 144 being visually different from the bands 146 facilitates maintaining the fabric pieces 500 in proper alignment during sewing operations. For instance, as the fabric pieces 500 are being advanced, the same amount of mirror image bands 144 or 146 (on which the edges 502, 504 are currently disposed) should be exposed. Moreover, the exposed portion of the mirror image bands 144 or 146 (in which the edges 502, 504 are currently disposed) should be of a uniform width over the length of the edges 502, 504.

The user may also maintain proper alignment of the fabric pieces 500 by keeping the first edge 502 parallel to the lines of the first plurality of angled guide lines 128 as the fabric pieces 500 are fed into the sewing machine 200. In another example, the user may maintain proper alignment of the fabric pieces 500 by keeping the second edge 504 parallel to the lines of the second plurality of angled guide lines 130. In still another example, the user may maintain proper alignment of the fabric pieces 500 by keeping the lead corner 506 disposed along the second portion 126 of the center guide line 114 as the fabric pieces 500 are fed into the sewing machine 200. In yet another example, the user may maintain proper alignment of the fabric pieces 500 by keeping the trailing corner 508 disposed along the first portion 124 of the center guide line 114 as the fabric pieces 500 are fed into the sewing machine 200. Furthermore, at any given point during the process the user may use one or more of the above methods of maintaining proper alignment. Indeed the user may use all of the above methods to ensure proper alignment of the fabric pieces 500.

Moreover, during the process of sewing the fabric pieces 500, the user may sequentially rely on a series of one or more of the above methods of maintaining proper alignment. For example, the user may initially align the fabric pieces 500 such that the first edge 502 is aligned with the first angled guide line 128*a* and the second edge 504 is aligned with the first angle to guide line 130*a*. During the initial stages of sewing the fabric pieces 500, the user may rely on keeping the first edge 502 and second edge 504 parallel to the corresponding respective pluralities of angled guide lines 128, 130. The alternating color-filled areas between the pluralities of angled guide lines 128, 130 may assist in ensuring that the fabric pieces 500 are being properly fed and aligned. For example, at any given moment, each of the first and second edges 502, 504 should be disposed against the same type of region (e.g., either both disposed against color-filled regions or both disposed against non-color-filled regions). As the first edge 502 and the second edge 504 move off of the modified sewing template 100', the user may then rely on keeping the trailing corner 508 along the first portion of the center guide line 124 to produce the straight sewn portion 510.

Once the fabric pieces 500 are sewn together as illustrated in FIG. 5C, excess material may be cut off by making a single cut parallel to and offset from sewn portion 510. The portions of the triangle square that remain sewn together may then be folded out along the sewn portion 510 such that the fabric pieces 500 collectively form a square with each individual piece of fabric of the fabric pieces 500 forming one half of the square (divided along a diagonal of the square). The folded out fabric pieces 500 may then be pressed to produce a triangle square operable to be incorporated into a quilt or other appropriate item.

Figure 6A:
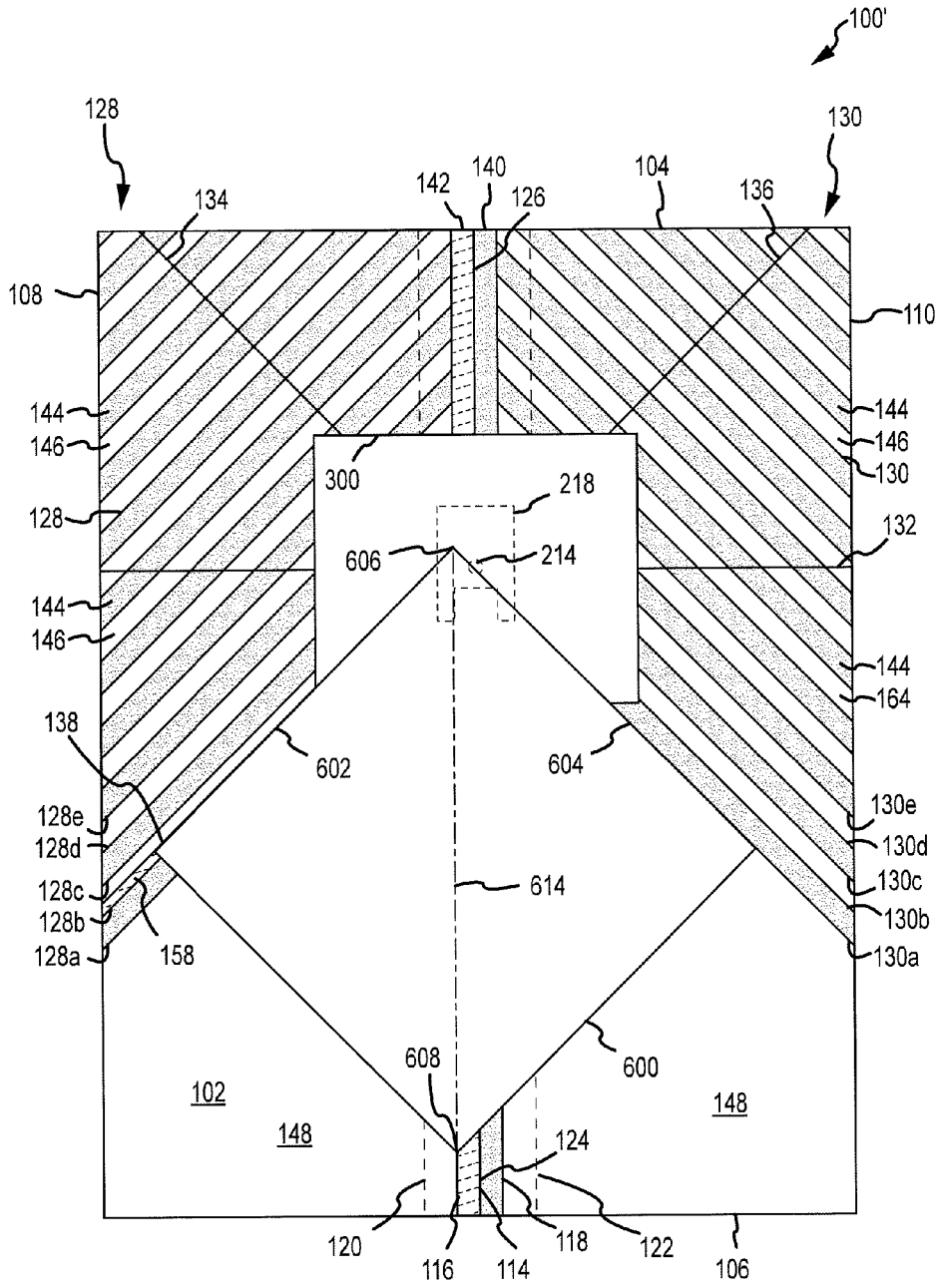
FIGS. 6A through 6C illustrate a sequence where the sewing template of FIG. 1 is used to join two square pieces of fabric together to produce a no-waste triangle square.
Figure 6B:
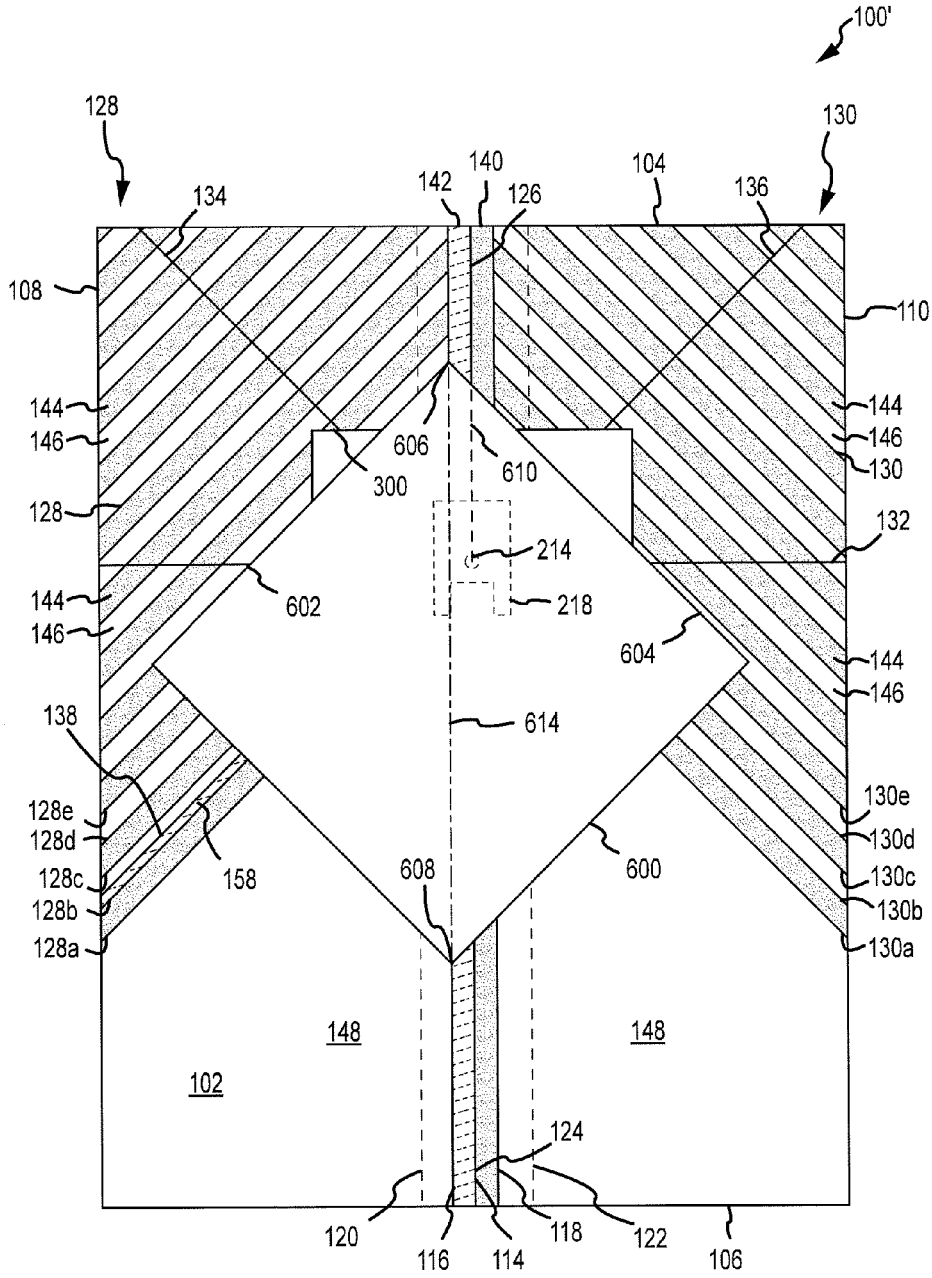
Figure 6C:
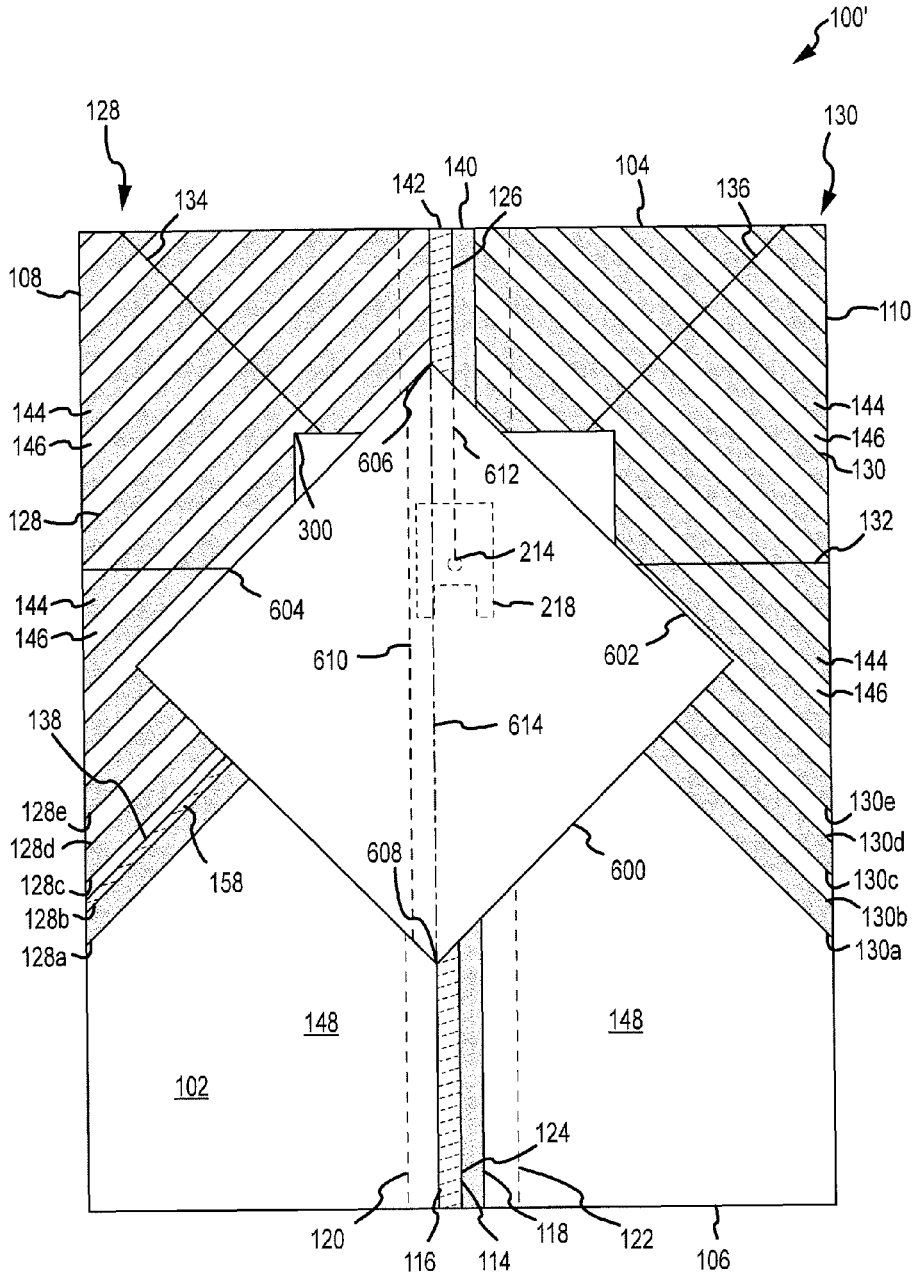

To produce a no-waste triangle square, two similarly sized square pieces of fabric 600 may be disposed face-to-face and aligned as illustrated in FIGS. 6A through 6C. In this regard, a first edge 602 of the fabric pieces 600 may be disposed along the no-waste guide line 138 and a trailing corner 608 of the fabric pieces may be disposed along the first offset guide line 116. As previously noted, the shading between the no-waste guide line 138 and the second angled guide line 128*b* and the shading between the first offset guide line 116 and the center guide line 114 may be similar. Such shading may assist in readily identifying that the no-waste guide line 138 and the first offset guide line 116 are to be used together to align the fabric pieces 600 for the production of no-waste triangle squares. When properly aligned, a second edge 604 of the fabric pieces 600 may be disposed along the first angled guide line 130*a*. Such an orientation will place the needle 214 such that it is offset from a center line 614 (e.g., connecting a lead corner 606 and the trailing corner 608) as illustrated in FIG. 6A.

Once aligned as illustrated in FIG. 6A, a user may begin to sew the fabric pieces 600 to each other by feeding the fabric pieces 600 into the sewing machine 200. As the fabric pieces 600 are fed into the sewing machine 200 (FIGS. 6B and 6C), several features of the modified sewing template 100' may aid the user in keeping the fabric pieces 600 properly aligned, thus helping to produce a first sewn portion 610 extending from the second edge 604 in a direction parallel to the center line 614 of the fabric pieces 600.

For example, while feeding the fabric pieces 600, the user may maintain proper alignment of the fabric pieces 600 by keeping the first edge 602 parallel to the lines of the first plurality of angled guide lines 128 as the fabric pieces 600 are fed into the sewing machine 200. In another example, the user may maintain proper alignment of the fabric pieces 600 by keeping the second edge 604 parallel to the lines of the second plurality of angled guide lines 130. In still another example, the user may maintain proper alignment of the fabric pieces 600 by keeping the lead corner 606 disposed along the first offset guide line 116 as the fabric pieces 600 are fed into the sewing machine 200. In yet another example, the user may maintain proper alignment of the fabric pieces 600 by keeping the trailing corner 608 disposed along the first offset guide line 116 as the fabric pieces 600 are fed into the sewing machine 200. Furthermore, at any given point during the process the user may use one or more of the above methods of maintaining proper alignment. Indeed the user may use all of the above methods to ensure proper alignment of the fabric pieces 600.

Moreover, during the process of sewing the first sewn portion 610 of the fabric pieces 600, the user may sequentially rely on a series of one or more of the above methods of maintaining proper alignment. For example, the user may initially align the fabric pieces 600 such that the first edge 602 is aligned with the no-waste guide line 138 and the trailing corner 608 is aligned with the first offset guide line 116. During the initial stages of sewing the fabric pieces 600 to produce the first sewn portion 610, the user may rely on keeping the first edge 602 parallel to the first plurality of angled guide lines 128 and keeping the trailing corner 608 along the first offset guide line 116. As the first edge 602 moves off of the modified sewing template 100', the user may then rely on keeping the trailing corner 608 along the first offset guide line 116 to produce the first sewn portion 610.

After the first sewn portion has been produced, the user may flip over the fabric pieces and repeat the process to produce a second sewn portion 612 as illustrated in FIG. 6C.

Once the fabric pieces 600 are sewn together (e.g., the fabric pieces 600 contain the first sewn portion 610 and the second sewn portion 612), the no-waste triangle square may be cut in half along the center line 614 connecting the lead corner 606 and the trailing corner 608 to produce two triangle squares. Next, the triangle squares may be folded out or opened, and pressed (if desired), to produce two triangle squares operable to be incorporated into a quilt or other appropriate item.

It will be appreciated that the sewing template 100 may be used to aid in the production of a wide variety of quilt patches. These include, for example, patches known as "flying geese"

and "snowballs." In particular, the first and second fabric alignment lines 134, 136 may be particularly helpful in producing "flying-geese." The sewing template 100 may also be used for alignment in a wide variety of other quilt patch related projects and non-quilt patch related projects. For example, the horizontal guide line 132 may be used to align material such that the direction to be sewn is perpendicular to the edge of the fabric aligned with the horizontal guide line 132. For another example, the first through fourth offset guide lines 116, 118, 120, 122 may be used to maintain alignment during sewing of various garment seams (e.g., where the fourth offset guide line 122 is offset by ⅝" from the center guide line 114, the fourth offset guide line 122 may be used to produce a ⅝" seam). Furthermore, it will be appreciated that the sewing template 100' may conform to the surfaces to which it is attached and accordingly will not interfere with use of the sewing to perform tasks that do not require and/or use the modified sewing template 100'.

The sewing template 100 provides a number of advantages. One is that the sewing template 100 is securely maintained in position for sewing operations by electrostatic forces (e.g., static electricity). Tape or other adhesives are not required to fix the sewing template 100 to the sewing work surface 204 or portable sewing table 220. As such, the sewing template 100 may be removed and reinstalled without producing any undesirable adhesive residue. Furthermore, the sewing template 100 can conform to uneven surfaces. For example, as illustrated in FIG. 2A, the sewing template 100' can conform and simultaneously adhere to the sewing work surface 204, the machine bed 202 and the top surface 210 of the work table 206 even if there is some misalignment between the various surfaces.

Other benefits of the sewing template 100 include having at least some transparent regions in at least some embodiments (e.g., for ease of visual access to the sewing machine; to facilitate installing the sewing template 100 on the sewing machine). The sewing template 100 also provides a smooth surface to engage the fabric being sewn and aids in the sliding of the fabric relative to the sewing template 100 during sewing operations (e.g., no drag or at least a reduced drag between the sewing template 100 and the fabric). The sewing template 100 may also be used for a variety of sewing operations. Finally, the sewing template 100 should also save time, should save fabric, and is easy to use and/or maintain alignment of the fabric due to its use of color coding.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A sewing template for aligning fabric pieces while being sewn together on a sewing machine, comprising:

a sheet;

a first guide line that is straight;

first and second pluralities of first bands disposed on first and second sides, respectively, of said first guide line;

first and second pluralities of second bands disposed on said first and second sides, respectively, of said first guide line;

a plurality of first angled guide lines that are straight, that are disposed on said first side of said first guide line, and that are disposed in parallel relation to each other, wherein each said first angled guide line is oriented at a 45° angle with respect to said first guide line;

a plurality of second angled guide lines that are straight, that are disposed on said second side of said first guide line, and that are disposed in parallel relation to each other, wherein each said second angled guide line is oriented at a 45° angle with respect to said first guide line, wherein each said first and second band disposed on said first side of said first guide line is located between an adjacent pair of said first angled guide lines, wherein each said first and second band disposed on said second side of said first guide line is located between an adjacent pair of said second angled guide lines, wherein each first band of said first and second pluralities of first bands is of a first color, wherein each second band of said first and second pluralities of second bands excludes said first color;

a third band on said first side of and adjacent to said first guide line;

a first offset guide line on said first side of said first guide line, wherein said first offset guide line is parallel to said first guide line, and wherein said third band is located between said first offset guide line and said first guide line; and an auxiliary guide line that is straight, that is disposed on said first side of said first guide line, that is parallel to said plurality of first angled guide lines, and that is disposed between an adjacent pair of said first angled guide lines, wherein said third band and a space between said auxiliary guide line and an adjacent said first angled guide line are of a common color.

2. The sewing template of claim 1, wherein each of said plurality of second bands comprises a transparent section of said sheet.

3. The sewing template of claim 1, wherein each of said plurality of second bands comprises a second color.

4. The sewing template of claim 1, wherein at least one second band is disposed between each adjacent pair of first bands on each of said first and second sides of said first guide line.

5. The sewing template of claim 1, further comprising a fourth band that adjoins said third band and that is different from said third band, wherein a boundary between said third and fourth bands defines said first guide line.

6. The sewing template of claim 5, wherein said third and fourth bands are of different colors.

7. The sewing template of claim 5, wherein said third and fourth bands are of a common width.

8. The sewing template of claim 5, wherein each of said third and fourth bands is ¼" wide.

9. The sewing template of claim 1, further comprising a second guide line that is orthogonal to said first guide line.

10. The sewing template of claim 9, further comprising third and fourth guide lines that are separated by an included angle of 90°, wherein said first, second, third, and fourth guide lines intersect at a common point.

11. The sewing template of claim 10, wherein said third guide line is orthogonal to each of said first plurality of first bands and said first plurality of second bands, and wherein said fourth guide line is orthogonal to each of said second plurality of first bands and said second plurality of second bands.

12. A sewing assembly comprising a sewing machine and the sewing template of claim 10, wherein said sewing machine comprises a sewing needle aligned with said common point.

13. The sewing template of claim 1, further comprising third and fourth guide lines disposed on opposite sides of and parallel to said first guide line, wherein said third and fourth bands are located between and spaced from each of said third and fourth guide lines.

14. The sewing template of claim 13, wherein said third and fourth guide lines are equally spaced from said first guide line.

15. The sewing template of claim 13, wherein said third and fourth guide lines are each spaced ⅝" from said first guide line.

16. The sewing template of claim 1, wherein one second band is disposed between each adjacent pair of first bands and adjoins each first band of said adjacent pair of first bands.

17. The sewing template of claim 1, further comprising a fifth band that adjoins a single one of said plurality of first bands, wherein said fifth band is located between said auxiliary guide line and one of said first angled guide lines.

18. A sewing assembly comprising a sewing machine comprising a bed, a support table that adjoins said bed, and the sewing template of claim 1, wherein said sewing template is fixed on and held relative to said support table exclusively by electrostatic charges.

19. A sewing template for aligning fabric pieces while being sewn together on a sewing machine, comprising:

a sheet;

a first guide line;

a second guide line that is orthogonal to said first guide line;

third and fourth guide lines that are separated by an included angle of 90°, wherein said first, second, third, and fourth guide lines intersect at a common point;

first and second pluralities of first bands disposed on first and second sides, respectively, of said first guide line; and first and second pluralities of second bands disposed on said first and second sides, respectively, of said first guide line, wherein each first band of said first and second pluralities of first bands is of a first color, and wherein each second band of said first and second pluralities of second bands excludes said first color.

20. A sewing template for aligning fabric pieces while being sewn together on a sewing machine, comprising:

a sheet comprising a top edge, a bottom edge, a left edge, and a right edge;

a first guide line that is straight extending between said top and bottom edges at a location between said left and right edges;

first and second pluralities of first bands disposed on first and second sides, respectively, of said first guide line, wherein each said first band of said first plurality of first bands extends from said left edge in a direction of said top edge, wherein each said first band of said second plurality of first bands extends from said right edge in a direction of said top edge, wherein said first bands on said first side of said first guide line are parallel to each other, and wherein said first bands on said second side of said first guide line are parallel to each other;

first and second pluralities of second bands disposed on said first and second sides, respectively, of said first guide line, wherein each said second band of said first plurality of second bands extends from said left edge in a direction of said top edge, and wherein each said second band of said second plurality of second bands extends from said right edge in a direction of said top edge, wherein said second bands on said first side of said first guide line are parallel to each other, wherein said second bands on said second side of said first guide line are parallel to each other, wherein one said second band is disposed between each adjacent pair of said first bands, wherein each first band is of a first color, and wherein each second band excludes said first color;

a third band on said first side of said first guide line and that is parallel to said first guide line; and a fourth band on said first side of said first guide line and that is parallel to each of said first and second bands on said first side of said first guide line, wherein said third and fourth bands are of a common color.

* * * * *